US006866311B2

(12) United States Patent
Spurr et al.

(10) Patent No.: US 6,866,311 B2
(45) Date of Patent: Mar. 15, 2005

(54) LATCH MECHANISM FOR A VEHICLE

(75) Inventors: Nigel Spurr, Solihull (GB); Mark Hao Li, Birmingham (GB); Michael Evans, Cheshire (GB)

(73) Assignee: ArvinMeritor Light Vehicle Systems (UK) Ltd. (GB)

( * ) Notice: Subject to any disclaimer, the term of this patent is extended or adjusted under 35 U.S.C. 154(b) by 0 days.

(21) Appl. No.: 10/317,007

(22) Filed: Dec. 11, 2002

(65) Prior Publication Data

US 2003/0178858 A1 Sep. 25, 2003

(Under 37 CFR 1.47)

(30) Foreign Application Priority Data

Dec. 22, 2001 (GB) ..... 0130858

(51) Int. Cl.[7] ..... E05C 3/06

(52) U.S. Cl. ..... 292/216; 292/DIG. 23; 292/201; 292/DIG. 43

(58) Field of Search ..... 292/201, 216, 292/DIG. 23, DIG. 42, DIG. 43

(56) References Cited

U.S. PATENT DOCUMENTS 4,203,621 A * 5/1980 Noel et al. ..... 292/216
5,979,951 A * 11/1999 Shimura ..... 292/216
6,109,671 A * 8/2000 Roncin et al. ..... 292/216
6,247,732 B1 * 6/2001 Alton ..... 292/216
6,267,420 B1 * 7/2001 Miyagawa ..... 292/216
6,378,920 B1 * 4/2002 Ostrowski et al. ..... 292/216
6,422,615 B1 * 7/2002 Roos et al. ..... 292/216
6,679,531 B2 * 1/2004 Rogers et al. ..... 292/216

FOREIGN PATENT DOCUMENTS

GB 2 162 234 1/1986
WO WO 95/09289 4/1995

* cited by examiner

*Primary Examiner*—Robert J. Sandy
*Assistant Examiner*—Thomas Ho
(74) *Attorney, Agent, or Firm*—Carlson, Gaskey & Olds

(57) ABSTRACT

A latch including a latch bolt movable between a primary latch position and an open position, a pawl moveable between a first engaged position where it secures the latch bolt in at least its primary latch position and a second released position where it releases the latch bolt from at least its first primary latch position, release means moveable between a rest position where it allows the pawl to achieve its first engaged position and an actuated position where it retains the pawl in its second released position, the latch bolt further including a secondary latch position, wherein the latch further comprises a capture means arranged so as to prevent engagement of the pawl in the secondary latch position during closure of the door, until the claw has rotated to a predetermined position beyond that at which engagement in the secondary latch position may otherwise occur.

13 Claims, 3 Drawing Sheets

LATCH MECHANISM FOR A VEHICLE

This application claims priority to Great Britain patent application number GB 0130858.4 filed on Dec. 22, 2001.

BACKGROUND OF THE INVENTION

The present invention relates to a latch. More particularly, but not exclusively the present invention relates to a latch for use with a lift gate (e.g. a hatchback or boot/trunk) of a vehicle.

All vehicle closures that allow access to the passenger compartment of a vehicle must, according to current legislation, be provided with a secondary latch position to ensure that the door does not unintentionally open whilst the vehicle is in motion, even if the closure has not been closed to the primary latch position.

As people carriers (minivans), off-road and estate (station wagon) vehicles have become increasingly prevalent on the car market, it has become necessary to fit latches having a secondary latch position to the rear tailgate/liftgate closures since seats are often provided in the rear part of the vehicle normally intended for luggage. In many vehicles, the rear closure is remotely releasable either using a switch located on the dashboard or by using a remote keyless entry (RKE) device.

Prior art latches have required the seal load (ie the force induced by the seals surrounding a closure that tend to urge the closure into an ajar condition) of the closure, and/or gas struts and the like to provide sufficient force to lift the closure past the secondary latch position so that when a user attempts to open the closure, they are not prevented from doing so by the pawl of the latch being engaged in the secondary latch position. However, a number of circumstances exist in which the seal load is insufficient to achieve this. For example, the seals surrounding the closure may have lost some of their resilience due to extended use, the weight of the closure may be too high for the available seal load, or there may be additional weight on the lift gate due to snow or ice that prevents the closure from being lifted beyond the secondary latch position. Problems may also occur when the user releases the latch from inside the vehicle. In this situation the closure initially clears the secondary latch position, but once the user exits the vehicle and slams the door, a build up of air pressure inside the vehicle lifts the closure which subsequently drops under the influence of its self weight and a vacuum induced inside the vehicle by the passenger door closing, thereby causing the latch to engage in the secondary latch position. All of these occurrences are undesirable since they may put vehicle users to significant inconvenience due to a second attempt to release the closure being required.

SUMMARY OF THE INVENTION

The present invention seeks to overcome, or at least mitigate, the problems with the prior art.

Accordingly, one aspect of the present invention provides a latch including a latch bolt movable between a primary latch position and an open position, a pawl moveable between a first engaged position where it secures the latch bolt in at least its primary latch position and a second released position where it releases the latch bolt from at least its first primary latch position, release means moveable between a rest position where it allows the pawl to achieve its first engaged position and an actuated position where it retains the pawl in its second released position, the latch bolt further including a secondary latch position, wherein the latch further comprises a capture means arranged so as to prevent engagement of the pawl in the secondary latch position during closure of the door, until the claw has rotated to a predetermined position beyond that at which engagement in the secondary latch position may otherwise occur.

BRIEF DESCRIPTION OF THE DRAWINGS

Embodiments of the present invention will now be described, by way of example only, with reference to the accompanying drawings in which.

DETAILED DESCRIPTION OF THE PREFERRED EMBODIMENT

Figure 1:
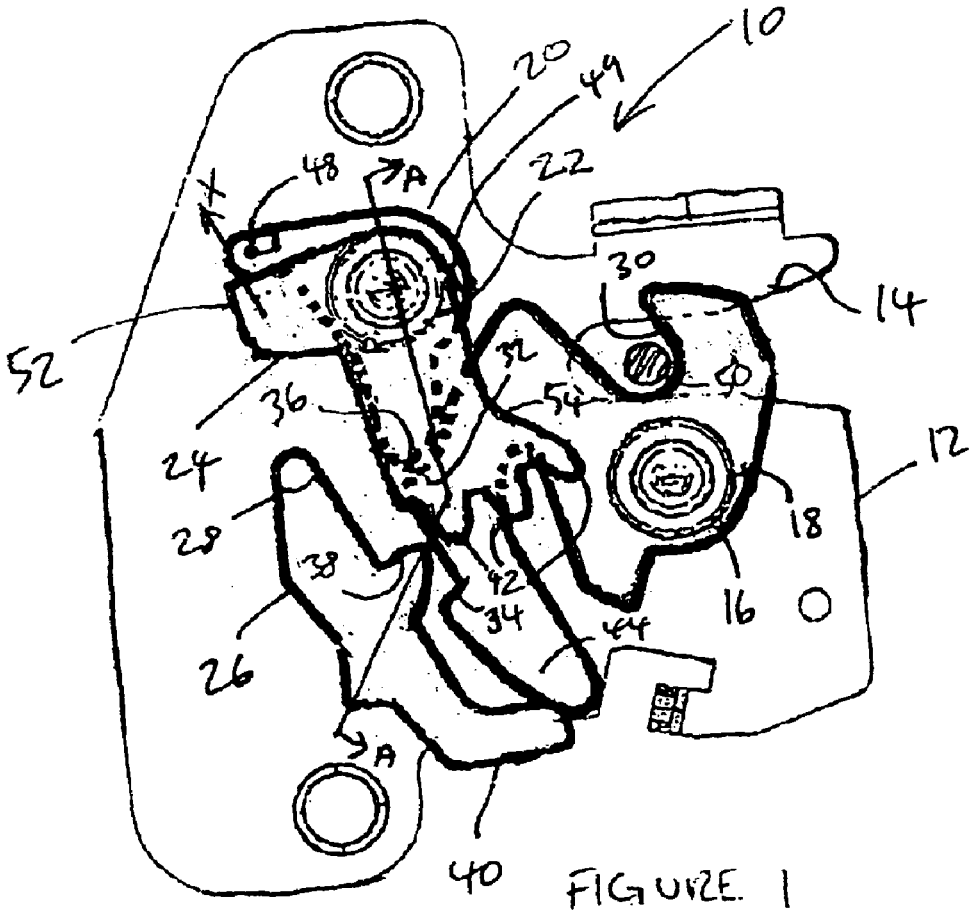
FIG. 1 is a side view of a latch according to an embodiment of the present invention in a fully latched condition.
Figure 4:
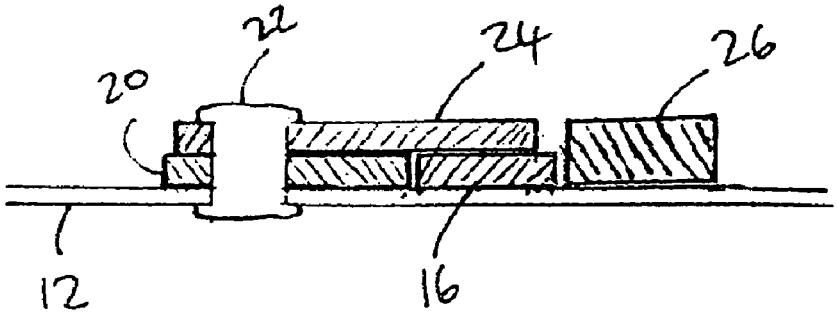
FIG. 4 is a cross-sectional view of the latch of FIG. 1 along the line A—A.

Referring to FIGS. 1 and 4, a latch 10 includes a chassis 12. The chassis 12 is provided with a mouth portion 14 and a latch bolt in the form of a claw 16 rotatable about a pivot pin 18 and resiliently biased into an open position. The claw 16 is arranged such that a mouth 30 thereof cooperates with the mouth portion 14 of the chassis 12 to releasably retain a striker 50. The latch 10 is further provided with a first abutment surface 32, a second abutment surface 34 and a projection 44, whose purpose is discussed in greater detail below.

A pawl 20 is rotatably mounted to the chassis 12 by a second pivot pin 22 and is resiliently biased into contact with the claw 16 by a helical spring (not shown) or other suitable means. The pawl 20 is provided with a pawl tooth 36 arranged to engage either the first abutment surface 32 or the second abutment surface 34. When the claw 16 is in a primary latch position, the first abutment surface 32 contacts the pawl 20. When the claw 16 is in a secondary latch position, the second abutment surface 34 contacts the pawl 20.

A release lever 24 is further rotatably mounted about the second pivot pin 22. The release lever 24 is rotatable relative to the pawl 20 and resiliently biased in a counter-clockwise direction. However, the angle of rotation is limited by lugs 48 and 49 mounted on the pawl 20, that in this embodiment project out of the paper from the pawl 20. The release lever 24 is substantially L-shaped. A first limb 52 of the release lever 24 is connected to a release input member, such as a power actuator (not shown) or outside closure release handle (not shown). The second limb 54 of the release lever 24 is provided with a plurality of teeth 42 whose function is described in greater detail below.

Figure 2:
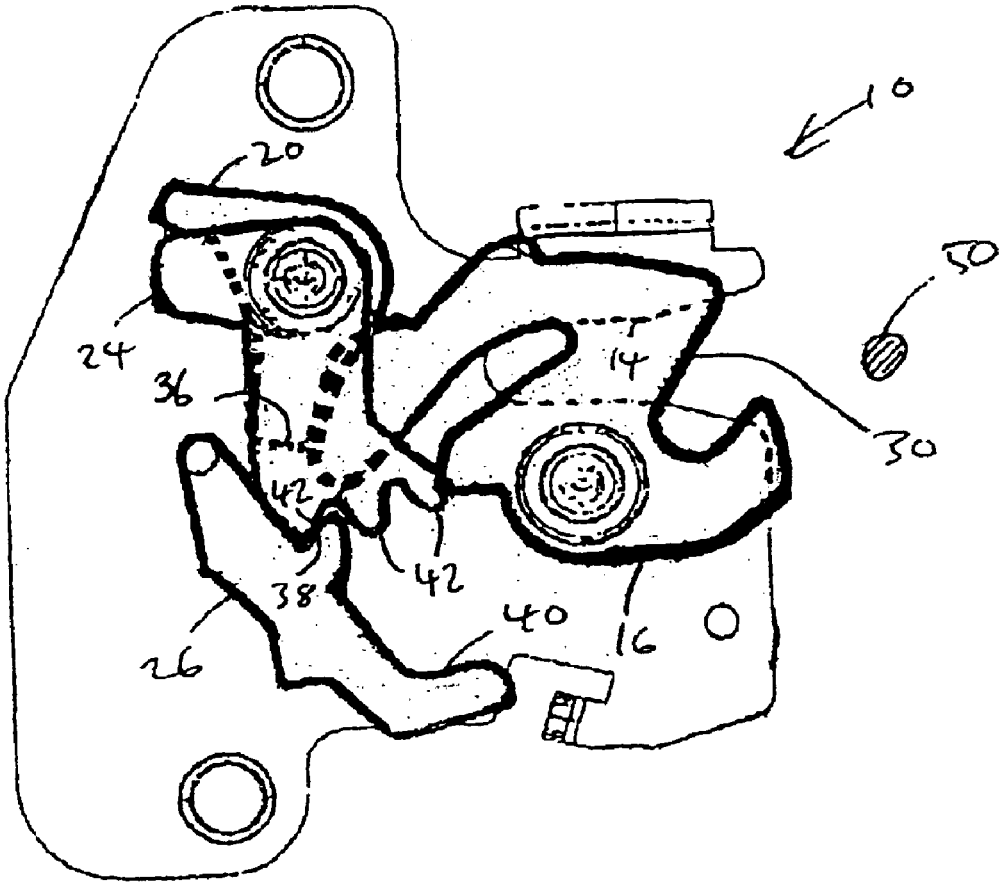
FIG. 2 is a side view of the latch of FIG. 1 in an open condition.

The latch 10 is further provided with a capture lever 26 rotatably mounted at one end thereof to the chassis 12 by a third pivot pin 28 and also resiliently biased in a counter-clockwise direction. The end of the capture lever 26 remote from the third pivot pin 28 is provided with a nose 40 arranged to engage the projection 44 of the claw 16 when the claw 16 is in a latched position (as shown in FIG. 1) and thereby to rotate the capture lever 26 in a clockwise direction. Intermediate the nose 40 and the third pivot pin 28 is a tooth 38 configured to engage with one of the plurality of teeth 42 provided on the release lever 24 and thereby to retain the release lever 24 in a released position as shown in FIG. 2.

In operation, and starting from a fully latched position as shown in FIG. 1, a vehicle user signals the unlatching of the latch either remotely from a RKE device, (not shown) a switch (not shown) provided in the vehicle passenger compartment (not shown), or via a release handle or button (not shown) mounted on the closure itself. This causes the release input means to pull the release lever 24 in a direction X. The release lever 24 rotates in a clockwise direction and the first limb 52 thereof abuts the lug 48 and causes the pawl tooth 36 to be lifted out of contact with the first abutment surface 32. The seal force acting on the closure and/or gas struts (not shown) causes the closure to open and the claw 16 to rotate and release the striker 50. As the claw 16 rotates, the projection 44 moves out of contact with the nose 40 of the capture lever 26, thereby causing the tooth 38 of the capture lever 26 to engage with one of the plurality of teeth 42 of the release lever 24, thereby retaining the release lever 24 in a release position. This latch open position is shown in FIG. 2. Note that during opening only a relatively small angular rotation of the claw 16 beyond the primary latch position is required before the tooth 38 of the capture lever 26 engages the release lever 24.

Figure 3:
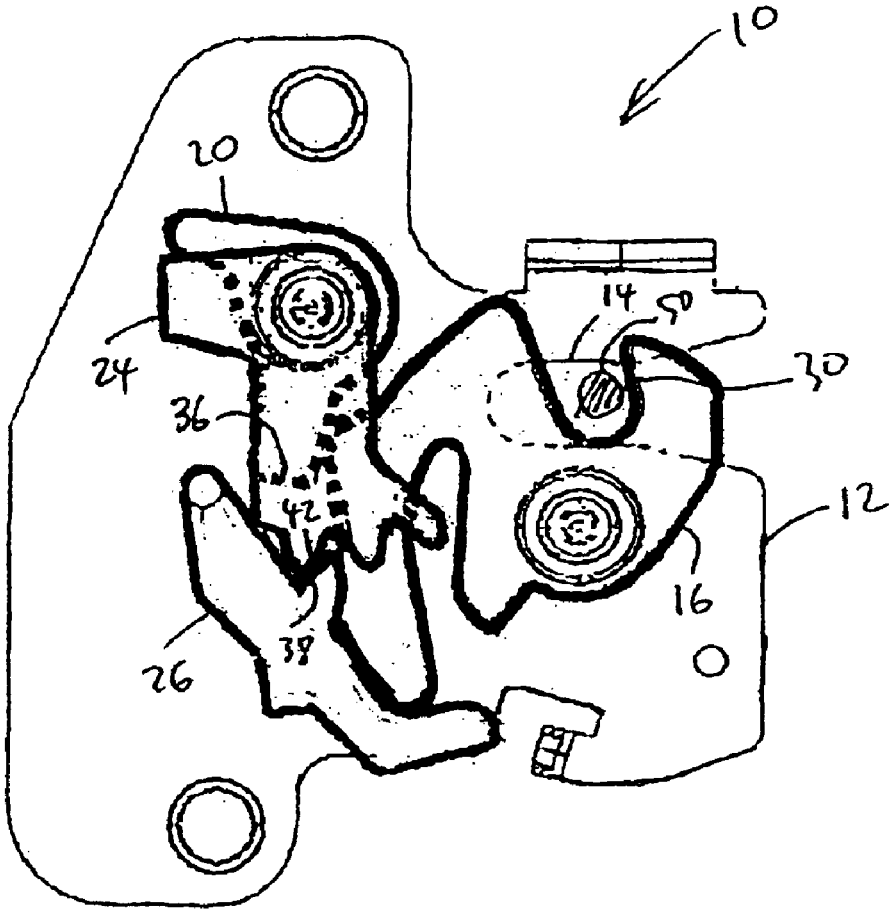
FIG. 3 is a side view of the latch of FIG. 1 in a latch closing condition.

It can be seen from FIG. 3 that if incomplete opening of the closure occurs due to one of the aforesaid problems (e.g. increased weight on the lift gate or a vacuum being induced inside the vehicle that tends to close the closure), the pawl tooth 36 is prevented from re-engaging with the second abutment surface 34 unless the claw 16 rotates sufficiently in a counter-clockwise direction for the projection 44 to engage the nose 40 to rotate the capture lever 26 and thereby disengage the tooth 38 from the teeth 42 of the release lever 24. This means that the pawl tooth 36 may again re-engage the first abutment surface 32, or if the rotation is not quite sufficient to engage the first abutment surface 32, for the claw 16 to rotate clockwise until the second abutment surface 34 is engaged. Note that disengagement may only occur once the claw 16 has rotated to a position at which the pawl tooth 36 is circumferentially intermediate the first abutment surface 32 and the second abutment surface 34. The precise position at which disengagement occurs may be adjusted by altering the spatial relationship between the projection 44 and the nose 40. In one embodiment, the claw 16 must rotate to a position significantly past the secondary latch position and virtually to the primary latch position before disengagement occurs. Alternatively, disengagement may occur at other positions such as one quarter, one half or three quarters of the way to the primary latch position from the secondary latch position.

It will thus be appreciated that the mechanism provided in the latch 10 of the present invention does not interfere with the normal operation of the latch 10 while ensuring that the latch 10 is not accidentally re-engaged in the secondary latch position when this is not desired.

It should be understood that numerous changes may be made within the scope of the present invention. For example, only a single tooth 42 may be provided on the release lever 24. The release lever 24 may be rotationally fast with the pawl 20 and the connection to the release input may be positioned on the second limb 54 of the release lever 24 rather than the first limb 52 and the first limb 52 may be omitted.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A latch comprising:

a latch bolt including a primary latch abutment and a secondary latch abutment, and the latch bolt being movable between a primary latch position and an open position, and a secondary latch position defined between the primary latch position and the open position;

a pawl moveable between an engaged position at which the pawl engages the primary latch abutment of the latch bolt and secures the latch bolt in at least the primary latch position and a released position at which a pawl releases the latch bolt from at least the primary latch position, and the pawl is engageable with the secondary latch abutment of the latch bolt to retain the latch bolt in the secondary latch position;

a release member moveable between a rest position at which the release member allows the pawl to achieve the engaged position and an actuated position at which the release member retains the pawl in the release position, wherein a lost motion connection is provided between the release member and the pawl; and a capture member to prevent engagement of the pawl with the latch bolt in the secondary latch position during closure of an associated door until the latch bolt has rotated to a predetermined position.

2. The latch according to claim 1 wherein the release member is a release lever.

3. The latch according to claim 1 wherein the release member and the capture member each include cooperating formations to prevent engagement of the pawl with the latch bolt in the secondary latch position.

4. The latch according to claim 1 wherein the capture member includes a nose portion that engage the latch bolt as the latch bolt approaches the primary latch position during closing of the associated door and thereby releases the release member to allow the pawl to engage the latch bolt.

5. The latch according to claim 1 wherein the latch bolt is a rotatable claw.

6. The latch according to claim 1 further including a chassis, and wherein the release member and the pawl are rotatably mounted to the chassis about a common axis.

7. The latch according to claim 1 wherein the release member and the pawl are rigidly secured together.

8. The latch according to claim 1 wherein the capture member is a capture lever.

9. The latch according to claim 1 wherein the predetermined position is at least one quarter of a distance primary latch position from the secondary latch position.

10. The latch according to claim 9 wherein the predetermined position is at least one half of a distance to the primary latch position from the secondary latch position.

11. The latch according to claim 10 wherein the predetermined position is at least three quarters of a distance to the primary latch position from the secondary latch position.

12. A latch comprising:

a latch bolt including a primary latch abutment and a secondary latch abutment, and the latch bolt being moveable between a primary latch position and an open position, and a secondary latch position defined between the primary latch position and the open position;

a pawl moveable between an engaged position at which the pawl engages the primary latch abutment of the latch bolt and secures the latch bolt in at least the primary latch position and a released position at which the pawl releases the latch bolt from at least the primary latch position, and the pawl is engageable with the secondary latch abutment of the latch bolt to retain the latch bolt in the secondary latch position;

a release member moveable between a rest position at which the release member allows the pawl to achieve the engaged position and an actuated position at which the release member retains the pawl in the release position, wherein the release member includes a plurality of teeth; and a capture member to prevent engagement of the pawl with the latch bolt in the secondary latch position during closure of associated door until the latch bolt has rotated to a predetermined position, wherein the capture member includes a tooth, and the tooth of the capture member engages one of the plurality of teeth of the release member to retain the release member in the actuated position.

13. The latch according to claim 1, wherein said secondary latch abutment protrudes from a surface of the latch bolt.

* * * * *

UNITED STATES PATENT AND TRADEMARK OFFICE

CERTIFICATE OF CORRECTION

PATENT NO. : 6,866,311 B2
DATED : March 15, 2005
INVENTOR(S) : Spurr et al.

It is certified that error appears in the above-identified patent and that said Letters Patent is hereby corrected as shown below:

Column 4,
Line 20, “a” should be -- the --
Line 27, second occurrence of “release” should be -- released --
Line 42, “engage” should be -- engages --
Line 56, add -- to the -- between “distance” and “primary”

Column 5,
Line 15, second occurrence of “release” should be -- released --

Column 6,
Line 6, add -- an -- before “associated”

Signed and Sealed this

Seventh Day of June, 2005

JON W. DUDAS
*Director of the United States Patent and Trademark Office*